US011801975B1

(12) United States Patent
DeCosmo, Jr.

(10) Patent No.: US 11,801,975 B1
(45) Date of Patent: Oct. 31, 2023

(54) STORABLE PLASTIC BAG SUPPORT APPARATUS

(71) Applicant: Michael A DeCosmo, Jr., St. Petersburg, FL (US)

(72) Inventor: Michael A DeCosmo, Jr., St. Petersburg, FL (US)

( * ) Notice: Subject to any disclaimer, the term of this patent is extended or adjusted under 35 U.S.C. 154(b) by 0 days.

(21) Appl. No.: 18/329,582

(22) Filed: Jun. 6, 2023

(51) Int. Cl.
*B65D 33/00* (2006.01)

(52) U.S. Cl.
CPC ..... *B65D 33/007* (2013.01)

(58) Field of Classification Search
CPC ..... B65D 33/007; B65F 1/1415
USPC ..... 383/33
See application file for complete search history.

(56) References Cited

U.S. PATENT DOCUMENTS 1,879,410 A * 9/1932 Morris ..... B65D 25/16 141/390
2,140,996 A * 12/1938 Heifetz ..... B65D 3/28 47/66.2
3,822,524 A * 7/1974 Jerpbak ..... B65F 1/1415 141/10
3,915,329 A * 10/1975 Zaks ..... B65F 1/1415 141/390
3,983,914 A * 10/1976 Benson ..... B65B 67/1238 141/390
4,955,496 A * 9/1990 Nelson ..... B65F 1/1415 141/390
7,367,600 B1 * 5/2008 Lew ..... B65F 1/10 294/152
7,958,580 B2 * 6/2011 Zorger ..... A47G 9/0253 5/489
2002/0162881 A1 * 11/2002 Umanoff ..... B65D 65/14 40/310
2005/0023417 A1 * 2/2005 Burns ..... B65B 67/1238 248/99
2019/0016529 A1 * 1/2019 Grace ..... B65F 1/1415

FOREIGN PATENT DOCUMENTS

CA 1289541 C * 9/1991 ..... B65B 67/1233

* cited by examiner

*Primary Examiner* — Jes F Pascua
(74) *Attorney, Agent, or Firm* — Larson & Larson; Frank Liebenow; Justin P. Miller

(57) ABSTRACT

A plastic bag support device includes a planar sheet that is made of a material. The material is bendable by human force (e.g., made of plastic or aluminum). The planar sheet has an insertion end at the first end and a receptor at a second end that is opposite the first end. A maintaining mechanism is affixed to the planar sheet between the first end and the second end. A storage clasp is affixed to the planar sheet between the first end and the second end, and a deployment clasp is affixed to the planar sheet between the first end and the storage clasp. In a storage configuration, the insertion end is disengaged with the receptor and the maintaining mechanism is engaged with the storage clasp and in a deployed configuration, the insertion end is engaged with the receptor and the maintaining mechanism is engaged with the deployment clasp.

20 Claims, 3 Drawing Sheets

STORABLE PLASTIC BAG SUPPORT APPARATUS

BACKGROUND OF THE INVENTION

Filing plastic bags is often difficult and messy. Plastic bags (e.g., the plastic bags that have a snap or zipper closure at an opening at one end or utilize a wire-tie for sealing and storing materials such as food) are made of a very flexible plastic material. To place food within such plastic bags, the opening needs to be held open while placing the contents into the plastic bag, then the opening can be sealed using the snap, zipper, or wire-tie closure mechanism.

When filling such plastic bags, it is often difficult to hold open the end having the opening while placing something inside the plastic bag. If one is placing a relatively stiff item within the plastic bag such as an apple or a sandwich, the difficulty is low. If one is placing a more fluid item into the plastic bag, the difficulty is much greater. For example, if pouring soup or cooked beans into the plastic bag, one must hold the container from which the soup or cooked beans originates while trying to hold open the plastic bag at the same time. In such, it is often needed to urge out some of the contents of the container, for example using a spoon or fork, further increasing the difficulty of filling the plastic bag. This difficulty often results in spilled contents or soiling of the opening to the plastic bag, which requires cleaning before closing of the plastic bag, so the soiled area does not go bad and contaminate the contents when the contents are later used.

What is needed is an apparatus that will hold open a plastic bag while filling and using, then conveniently roll up for storage of the apparatus.

SUMMARY OF THE INVENTION

In one embodiment, a plastic bag support device is disclosed including a planar sheet, the planar sheet made of a material. The material is bendable by human force (e.g., made of plastic or aluminum). The planar sheet has an insertion end at a first end and a receptor at a second end that is opposite the first end. A maintaining mechanism is affixed to the planar sheet between the first end and the second end. A storage clasp is affixed to the planar sheet between the first end and the second end and a deployment clasp is affixed to the planar sheet between the first end and the storage clasp. In a storage configuration, the insertion end is disengaged with the receptor and the maintaining mechanism is engaged with the storage clasp and in a deployed configuration, the insertion end is engaged with the receptor and the maintaining mechanism is engaged with the deployment clasp.

In another embodiment, a plastic bag support device is disclosed including a planar sheet. The material is selected from a group consisting of plastic, aluminum, cardboard, cardstock, and manila; and has an insertion end at a first end and a receptor at a second end that is opposite the first end. A maintaining mechanism that is made of a loop of elastic string has ends passing through holes in the planar sheet that are located between the first end and the second end of the planar sheet. The ends of the elastic string held in the holes by knots tied in the ends of the elastic string or by end-Ts formed at the ends of the elastic string. A storage clasp is affixed to the planar sheet between the first end and the second end and a deployment clasp affixed to the planar sheet between the first end and the storage clasp. In a storage configuration, the insertion end is disengaged with the receptor and the maintaining mechanism is engaged with the storage clasp and in a deployed configuration, the insertion end is engaged with the receptor and the maintaining mechanism is engaged with the deployment clasp.

In another embodiment, a method of holding a plastic bag for accepting and/or deploying the content to/from the plastic bag is disclosed including providing a plastic bag support apparatus that includes a planar sheet that is made of a material. The planar sheet has an insertion end at the first end and a receptor at a second end that is opposite the first end. There is a maintaining mechanism made of a loop of elastic string, ends of the elastic string passing through holes in the planar sheet that are positioned in the planar sheet between the first end and the second end. Ends of the elastic string are held in the holes by knots tied in the ends of the elastic string or by end-Ts formed at the ends of the elastic string. A storage clasp is affixed to the planar sheet between the first end and the second end, and a deployment clasp is affixed to the planar sheet between the first end and the storage clasp. The method includes removing the maintaining mechanism from the storage clasp and stretching the planar sheet to engage the insertion end into the receptor the wrapping the maintaining mechanism around the deployment clasp so that the planar sheet forms a cylinder sized for accepting a plastic bag. Now, the plastic bag is opened, and a body of the plastic bag is inserted into the cylinder of the planar sheet, wrapping an edge of the plastic bag that is at an open end of the plastic bag around a top surface of the cylinder, thereby enabling introduction of content into the plastic bag and removal of contents from the plastic bag.

BRIEF DESCRIPTION OF DRAWINGS

The invention can be best understood by those having ordinary skill in the art by reference to the following detailed description when considered in conjunction with the accompanying drawings in which.

DETAILED DESCRIPTION OF THE INVENTION

Figure 1:
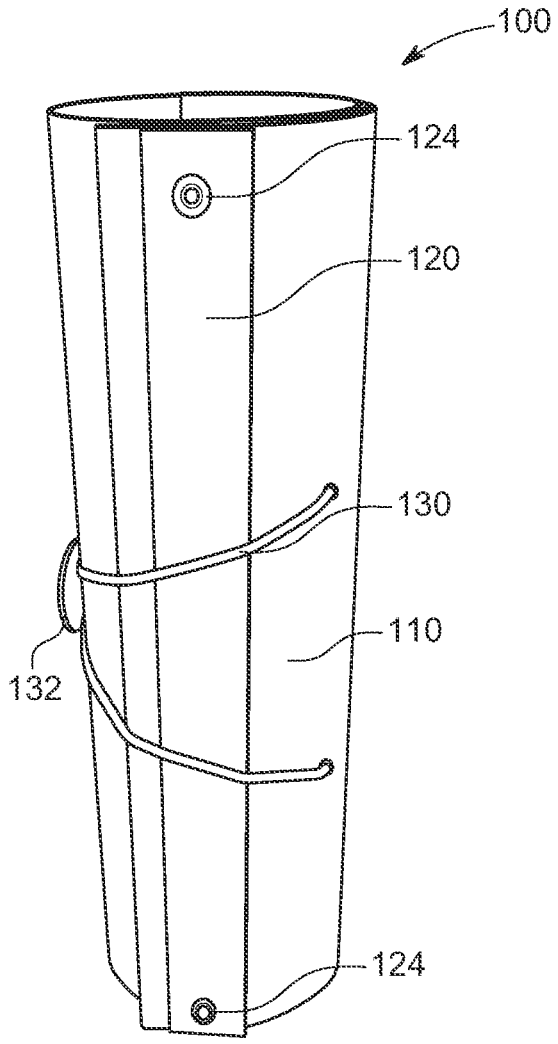
FIG. 1 illustrates a perspective view of a plastic bag support apparatus in a storage configuration.

Reference will now be made in detail to the presently preferred embodiments of the invention, examples of which are illustrated in the accompanying drawings.

Throughout the following detailed description, the same reference numerals refer to the same elements in all figures.

Throughout this document, the term plastic bag refers to any plastic bag that is commonly used to store materials such as pills, food, or other items. Often, the materials that are stored include liquids or powders making it difficult to place such materials into the plastic bag, as the opening to the plastic bags is often very flexible and does not remain open without assistance. In the past, a second person was often required to hold open the plastic bags while the material is deposited into the plastic bag, and even when extracting the material from the plastic bag.

Referring to FIG. 1, a perspective view of a plastic bag support apparatus 100 in a storage configuration is shown. As the plastic bag support apparatus 100 is often used intermittently (e.g., used, stored, used, stored), it is often desired to reduce the size of the plastic bag support apparatus 100 for storage in a kitchen cabinet, drawer, backpack, etc. As shown in FIG. 1, the plastic bag support apparatus 100 is rolled-up into a tighter configuration for storage or when not in use. In such, there is a storage clasp 132 affixed to an outside surface of the support body 110 at a location that will hold the support body 110 in a reduced-size configuration as shown in FIG. 1, for example, for storing the plastic bag support apparatus 100. The maintaining mechanism 130 (e.g., a string or a resilient material such as an elastic band) is affixed to the support body at one or two points and wraps around the storage clasp 132 to hold the plastic bag support apparatus 100 in the reduced-size configuration until the maintaining mechanism 130 is unwrapped from the storage clasp 132 for deployment as shown in FIG. 2.

Figure 2:
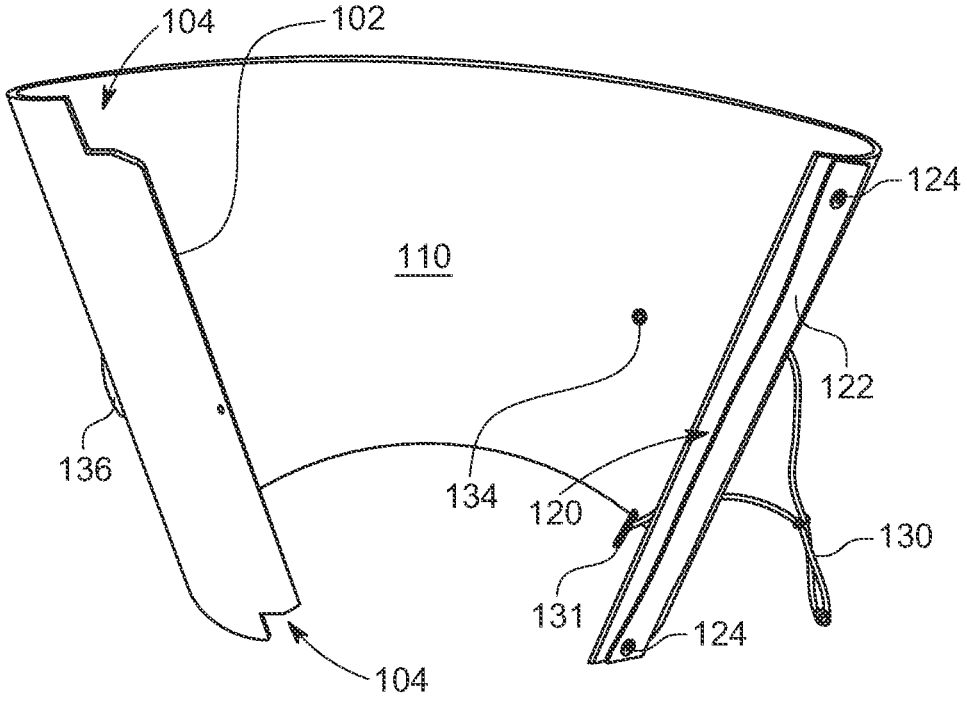
FIG. 2 illustrates a perspective view of the plastic bag support apparatus showing inside surfaces.

Referring to FIG. 2, a perspective view of the plastic bag support apparatus 100 showing inside surfaces is shown. In this, the inside surface of the support body 110 is visible and the approximate location of the storage clasp 132 (not visible) is noted by the location of a support apparatus fastener 134 that passes through the support body 110 and secures the storage clasp 132 to the support body 110. Note that any known support apparatus fastener is anticipated including, but not limited to, stitching, string, a nut and bold, and a rivet. For the remainder of this description, the support apparatus fastener 134 is shown as a rivet.

A deployment clasp 136 is visible in FIG. 2. The deployment clasp 136 is used with the maintaining mechanism 130 to hold the plastic bag support apparatus 100 in a deployed configuration (see FIG. 3) by inserting the leading edge 102 of the support body 110 into the receptor 120 of the support body 110. Note that the leading edge 102 and receptor 120 are at opposite ends of the support body 110. In the embodiment shown in FIG. 2, the receptor 120 is formed by fastening a separate sheet 122 of material that is similar to the support body 110 to the support body 110 using fasteners 124. Note that any known fastener 124 is anticipated including, but not limited to, stitching, string, a nut and bold, and a rivet. For the remainder of this description, the fastener 124 is shown as a rivet. Note also, although it is shown that the separate sheet 122 is mounted on an outside surface of the support body 110, in some embodiments the separate sheet 122 is mounted on an inside surface of the support body 110 instead.

Figure 3:
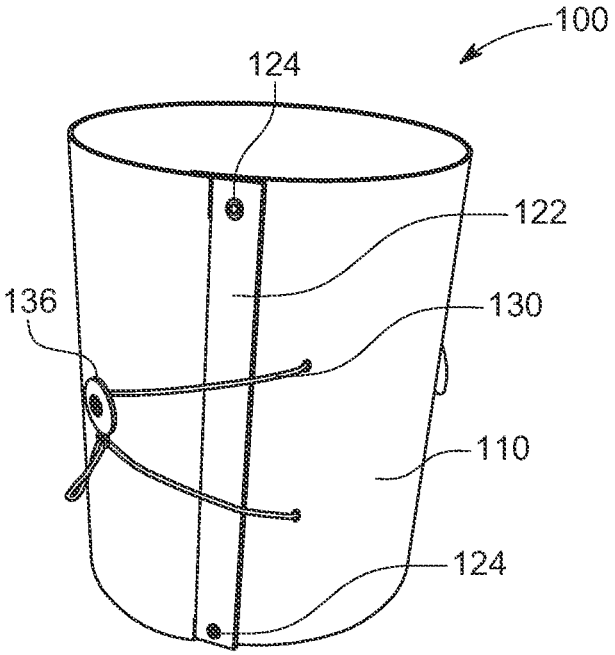
FIG. 3 illustrates perspective view of the plastic bag support apparatus in a usage configuration.

It is anticipated that the support body 110 be made of a planar sheet of material that is stiff enough to maintain the cylindrical form as shown in FIGS. 1 and 3, yet flexible enough to allow bending and stretching between the storage configuration as shown in FIG. 1 and the deployed configuration or usage configuration as shown in FIG. 3 by exertion of human force (e.g., the amount of force a human being is capable of exerting in such a planar sheet of material). Therefore, it is anticipated that the support body 110 be made of a planar sheet of plastic, though any suitable material including, but not limited to, aluminum, cardboard, heavy-stock paper, and manila hemp (e.g., material manila folders are made from). Not that in some embodiments, the support body 110 is coated or painted for color and in some embodiments messaging or logos are printed or attached to the support body 110 for product identification, instruction, and/or advertising purposes.

The storage clasp 132 is affixed to the support body 110 between the leading edge 102 of the support body 110 and the receptor 120.

In the embodiment of FIG. 2, the maintaining mechanism 130 is shown as an elastic string that passes through holes (not shown) in the support body 110 and is held against the holes by end-Ts 131 as known in the fashion industry for inserting price tags onto clothing, though any other way of affixing ends of the maintaining mechanism 130 to the support body is anticipated including, but not limited to, tying a knot in the maintaining mechanism, tape, glue, ultrasonic welding, any type of adhesive, and a rivet.

Also, in the embodiment of FIG. 2, the leading edge 102 of the support body 110 has notches 104 that are cut to allow clearance of the leading edge 102 of the support body 110 when inserted into the receptor 120 to avoid the fasteners 124, though in alternate embodiments (e.g., as in FIGS. 5 and 6), the notches 104 are not present as there the fasteners 124 are not present and need not be avoided.

Operation of the deployment clasp 136 will be discussed with FIG. 3. Note that the deployment clasp 136 is the same, a similar, or different type of clasp as the storage clasp 132 and is held to the support body by any way described above for the storage clasp 132, though throughout this document, the deployment clasp 136 is held to the support body 110 by a rivet. The deployment clasp 136 is affixed to the support body 110 between the leading edge 102 of the support body 110 and the storage clasp 132.

Referring to FIG. 3, perspective view of the plastic bag support apparatus 100 in a usage configuration is shown. In the usage configuration, the leading edge 102 (not visible in FIG. 3) is inserted into the receptor 120 (e.g., between the separate sheet 122 and the support body 110). Note that only the separate sheet 122 is visible in FIG. 3. Note also, that in some embodiments the separate sheet 122 is mounted on an inside surface of the support body 110 instead of on an outside surface of the support body 110.

Once the leading edge 102 (not visible in FIG. 3) is inserted into the receptor 120, the maintaining mechanism 130 is engaged with the deployment clasp 136 to maintain the leading edge 102 within the receptor 120.

Figure 4:
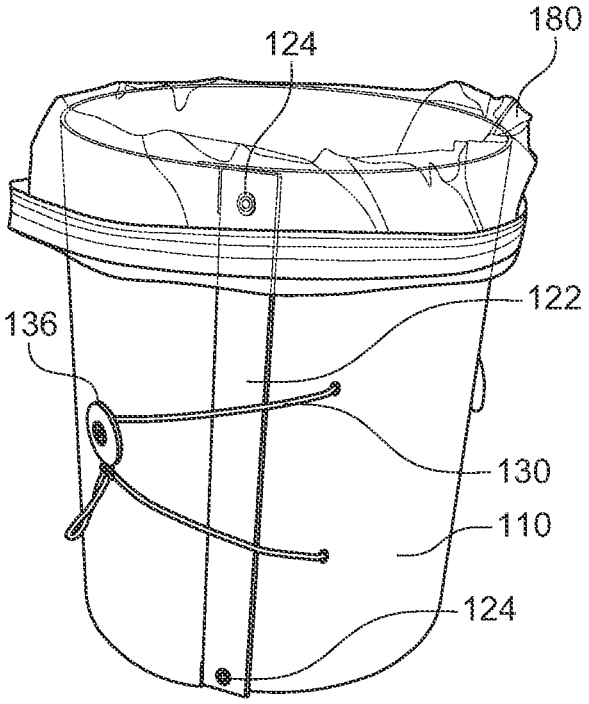
FIG. 4 illustrates perspective view of the plastic bag support apparatus in a usage configuration having installed thereon a plastic bag.

Referring to FIG. 4, perspective view of the plastic bag support apparatus 100 in a usage configuration having installed thereon a plastic bag 180 is shown. After engaging the leading edge 102 with the receptor 120 and securing by engaging the maintaining mechanism 130 with the deployment clasp 136, the plastic bag support apparatus 100 accepts a plastic bag 180 by draping the opening of the plastic bag 180 over an upper rim formed by the support body 110, thereby holding open the opening of the plastic bag 180 for introducing or removing materials to be stored in the plastic bag 180 or removed from the plastic bag 180. As the plastic bag 180 is held substantially open, once the plastic bag 180 is supported by the plastic bag support apparatus 100, the user is free to use both hands for properly moving the materials to/from the plastic bag (e.g., using a spoon or spatula to urge materials such as beans or pasta from another container into the plastic bag). When done, the plastic bag 180 is lifted from the plastic bag support apparatus 100 and sealed as per the sealing mechanism of the plastic bag 180 (or discarded, etc.).

Figure 5:
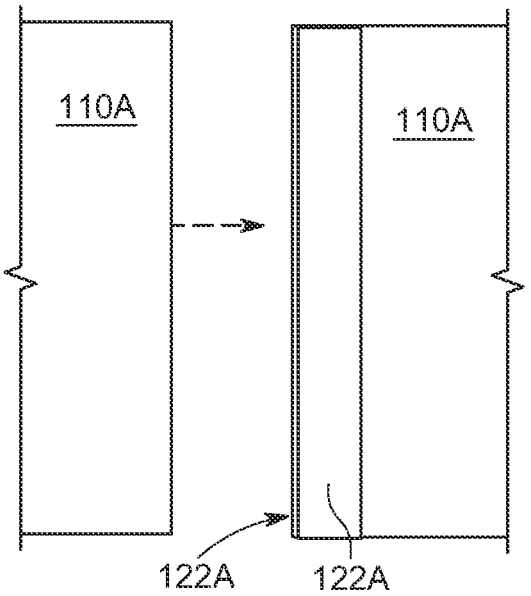
FIG. 5 and FIG. 6 illustrate an alternate receptor mechanism.
Figure 6:
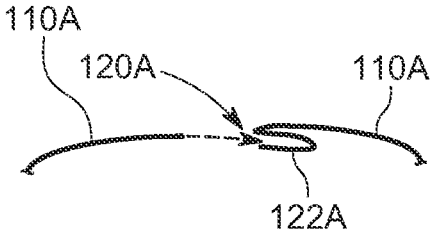

Referring to FIGS. 5 and 6, an alternate receptor 120A of the plastic bag support apparatus 100 is shown. As, when the plastic bag support apparatus 100 is deployed, it is desired to maintain the leading edge 102 in place within the receptor 120, an alternate receptor 120A is shown in FIGS. 5 and 6. The alternate receptor 120A is formed at an end of the support body 110A that is distal from the leading edge 102, The alternate receptor 120A is formed as a fold 122A. As the support body 110A is made from a stiff, but bendable material (e.g., plastic, aluminum, cardboard—see above), in some embodiments, the alternate receptor 120A is formed at a surface of the support body 110A instead of having a separate sheet of the material affixed to the support body 110 as in the previous embodiment. Note that as the fold 122A is continuous along the edge of the support body 110A (e.g., there are no fasteners that would impede insertion of the leading edge 102), the support body 110A is shown without having any notches 104 that were required in the prior embodiment to provide clearance around the fasteners 124.

As above, the embodiments of FIGS. 5 and 6 function in the same manner as the embodiments of FIGS. 1-4, moving between the storage configuration and the deployed configuration as above.

In all embodiments, the support body 110 is formed in a size that provides support to a certain size of plastic bag 180. For example, the support body 110 is formed in a larger size for holding plastic bags 180 of the gallon size and the support body 110 is formed in a smaller size for holding plastic bags 180 of the quart size, etc.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. A plastic bag support apparatus comprising:

a planar sheet, the planar sheet made of a material, the material being bendable by human force, the planar sheet having an insertion end at a first end and a receptor at a second end that is opposite the first end;

a maintaining mechanism affixed to the planar sheet between the first end and the second end;

a storage clasp affixed to the planar sheet between the first end and the second end;

a deployment clasp affixed to the planar sheet between the first end and the storage clasp; and whereas in a storage configuration, the insertion end is disengaged with the receptor and the maintaining mechanism is engaged with the storage clasp and in a deployed configuration, the insertion end is engaged with the receptor and the maintaining mechanism is engaged with the deployment clasp.

2. The plastic bag support apparatus of claim 1, wherein the receptor is formed as bends in the second end.

3. The plastic bag support apparatus of claim 1, wherein the receptor is formed by affixing a strip of the material to the planar sheet at the second end.

4. The plastic bag support apparatus of claim 3, wherein the strip of the material is affixed to the planar sheet at the second end by rivets.

5. The plastic bag support apparatus of claim 1, wherein the maintaining mechanism is a resilient loop.

6. The plastic bag support apparatus of claim 5, wherein the resilient loop is made of elastic string.

7. The plastic bag support apparatus of claim 6, wherein ends of the elastic string pass through holes in the planar sheet and is fixed in the holes by knots or by end-Ts.

8. The plastic bag support apparatus of claim 1, wherein the material is selected from a group consisting of plastic, aluminum, cardboard, cardstock, and manila.

9. The plastic bag support apparatus of claim 1, wherein the storage clasp is affixed to the planar sheet using a rivet and the deployment clasp is affixed to the planar sheet using another rivet.

10. A plastic bag support apparatus comprising:

a planar sheet, the planar sheet made of a material, the material is selected from a group consisting of plastic, aluminum, cardboard, cardstock, and manila, the planar sheet having an insertion end at a first end and a receptor at a second end that is opposite the first end;

a maintaining mechanism made of a loop of elastic string, ends of the elastic string passing through holes in the planar sheet, the holes positioned in the planar sheet between the first end and the second end, the ends of the elastic string held in the holes by knots tied in the ends of the elastic string or by end-Ts formed at the ends of the elastic string;

a storage clasp affixed to the planar sheet between the first end and the second end;

a deployment clasp affixed to the planar sheet between the first end and the storage clasp; and whereas in a storage configuration, the insertion end is disengaged with the receptor and the maintaining mechanism is engaged with the storage clasp and in a deployed configuration, the insertion end is engaged with the receptor and the maintaining mechanism is engaged with the deployment clasp.

11. The plastic bag support apparatus of claim 10, wherein the receptor is formed as bends in the second end.

12. The plastic bag support apparatus of claim 10, wherein the receptor is formed by affixing a strip of the material to the planar sheet at the second end.

13. The plastic bag support apparatus of claim 12, wherein the strip of the material is affixed to the planar sheet at the second end by rivets.

14. The plastic bag support apparatus of claim 10, wherein the storage clasp is affixed to the planar sheet using a rivet and the deployment clasp is affixed to the planar sheet using another rivet.

15. A method of holding a plastic bag for accepting and/or deploying a content to/from the plastic bag, the method comprising:

providing a plastic bag support apparatus comprising:

a planar sheet, the planar sheet made of a material, the planar sheet having an insertion end at a first end and a receptor at a second end that is opposite the first end; a maintaining mechanism made of a loop of elastic string, ends of the elastic string passing through holes in the planar sheet, the holes positioned in the planar sheet between the first end and the second end, the ends of the elastic string held in the holes by knots tied in the ends of the elastic string or by end-Ts formed at the ends of the elastic string, a storage clasp is affixed to the planar sheet between the first end and the second end and a deployment clasp is affixed to the planar sheet between the first end and the storage clasp;

removing the maintaining mechanism from the storage clasp;

stretching the planar sheet and engaging the insertion end into the receptor;

engaging the maintaining mechanism with the deployment clasp, whereas the planar sheet is formed as a cylinder sized for accepting a plastic bag;

opening the plastic bag;

inserting a body of the plastic bag into the cylinder of the planar sheet; and wrapping an edge of the plastic bag that is at an open end of the plastic bag around a top surface of the cylinder, thereby enabling introduction of content into the plastic bag and removal of contents from the plastic bag.

16. The method of claim 15, further comprising:

removing the plastic bag from the plastic bag support apparatus;

removing the maintaining mechanism from the deployment clasp;

stretching the planar sheet and disengaging the insertion end from the receptor; and engaging the maintaining mechanism with the storage clasp, whereas the planar sheet is formed as a second cylinder that is smaller than the cylinder for storing the plastic bag support apparatus.

17. The method of claim 15, wherein the receptor is formed as bends in the second end.

18. The method of claim 15, wherein the receptor is formed by affixing a strip of the material to the planar sheet at the second end.

19. The method of claim 18, wherein the strip of the material is affixed to the planar sheet at the second end by rivets.

20. The method of claim 15, wherein the storage clasp is affixed to the planar sheet using a rivet and the deployment clasp is affixed to the planar sheet using another rivet.

* * * * *